United States Patent [19]

Biller

[11] Patent Number: 4,510,981

[45] Date of Patent: Apr. 16, 1985

[54] SELF-CENTERING FEEDING DEVICE

[75] Inventor: Sven-Olov Biller, Söderhamn, Sweden

[73] Assignee: KOCKUMS Industri AB, Söderhamn, Sweden

[21] Appl. No.: 420,692

[22] Filed: Sep. 20, 1982

[30] Foreign Application Priority Data

Dec. 21, 1981 [SE] Sweden ..... 8107654

[51] Int. Cl.[3] ..... B27C 1/12

[52] U.S. Cl. ..... 144/246 F; 144/246 C; 198/624; 198/586; 198/782; 226/184; 226/188; 226/193

[58] Field of Search ..... 198/624, 586, 782; 144/242 R, 246 R, 246 C, 246 D, 246 E, 246 F, 246 G; 226/181, 184, 187, 188, 193

[56] References Cited

U.S. PATENT DOCUMENTS 3,098,512 7/1963 Kendrick ..... 144/246 C 3,833,162 9/1974 Sato ..... 144/246 F

*Primary Examiner*—W. D. Bray

*Attorney, Agent, or Firm*—Browdy and Neimark

[57] ABSTRACT

The self-centering feeding device (20') for elongated objects such as logs includes a conveyor means (30) carried by a parallel mechanism having a vertical stationary part. The parallel mechanism is connected to a mechanical engagement means (26) and is controlled by a driving means (28) activated when an object on the conveyor means reaches a predetermined position, and is then kept activated the whole time during which the object is fed-through. The object is thus firmly clamped between the conveyor means and the engagement means and has no possibility to rotate about its longitudinal axis. The conveyor means may therefore be much shorter than the object. The invention is suitable for general application, but in particular for application in the log processing industry.

10 Claims, 4 Drawing Figures

SELF-CENTERING FEEDING DEVICE

BACKGROUND OF THE INVENTION

The invention refers to a self-centering feeding device for elongated objects such as logs which shall be processed in a processing machine such as a barker or the like. A feeding device of this kind is described e.g. in the German Pat. No. 1,217,050 issued on Dec. 8, 1966 to B. Valo and comprises a stand, a longitudinal feeder carried by the stand with the aid of a parallel mechanism so as to be vertically adjustable in such a manner that the body of the feeder remains substantially horizontal, and, for controlling the vertical adjustment of the feeder, a mechanical sensor means located above the feeder. The sensor means is defined by a flap which at one end is pivoted to a part which vertically protrudes from the body of the feeder. A rigid stay is at one end pivoted to the flap in half the length thereof and at its other end is pivoted to the stand. The parallel mechanism comprises two crooked link means pivoted to the stand at horizontally spaced locations so that the whole parallel mechanism is elongated in horizontal direction and has a horizontal stationary part. The parallel mechanism is constantly affected by a spring means in such a way that the rest or initial position of the feeder is the highest position thereof, and the rest or initial position of the sensor means is the lowest position thereof. As a result, the gap between the feeder and the sensor means is smallest in the initial position of the device, and the spring means must therefore be relative weak in order that a log which is forwarded on the feeder may be able to separate the feeder and the flap and penetrate into the gap. Consequently, the log cannot be firmly grasped by the centering device so as to be prevented from rotating. The feeding device must be so long as the longest treated logs are expected to be, e.g. 6 m, and an upwardly inclined ramp must be installed at the feed-in end of the feeder due to the fact that the initial or rest position of the feeder is in the elevated position thereof.

In the German patent application Ser. No. P 20 20 27 399 filed on June 4, 1970 by J. Kuhn and published in print on Dec. 9, 1971, as DS No. 2,027,399, a barking machine is described which is provided with a conveyor device comprising two pairs of feeder rollers mounted in a shear mechanism affected by a cylinder-piston-unit. The conveyor device is not able to hold horizontally a log which is unsupported at its rear end.

It is an object of the present invention to provide a feeding device of the kind aforesaid deprived of the above mentioned disadvantages, i.e. a feeding device which (1) firmly grasps the object to prevent its rotations about its longitudinal axis, (2) does not need to be as long as the longest object to be treated, because with the firm grasp at the forward end of the object the rear end thereof may be unsupported, and (3) does not need a feed-in ramp, because the initial position of the feeder is the lowermost position thereof.

The invention is characterized by the features evident from the annexed patent claims. Also the circumstance that the parallel mechanism in the present invention is oriented vertically and has a vertical stationary part contributes to making the device as short as convenient. The firm grasp of the feeder and sensor means on the log also has the advantage that upon use in connection with a barking machine, a special feeder device, conventional in such machines to prevent rotation of the log, may be omitted, because the function thereof is fully taken over by the feeder device of the invention when positioned closely adjacent to the barking machine.

BRIEF DESCRIPTION OF THE INVENTION

The invention will now be explained more in detail with the aid of the accompanying drawings in which FIG. 1 is a side elevational view of a first embodiment, FIG. 2 is a side elevational view of a second embodiment, FIG. 3 is a front elevational view of the embodiment of FIG. 2, and FIG. 4 is a side elevational view, similar to FIG. 2. of a third embodiment.

DETAILED DESCRIPTION OF THE INVENTION

Figure 1:
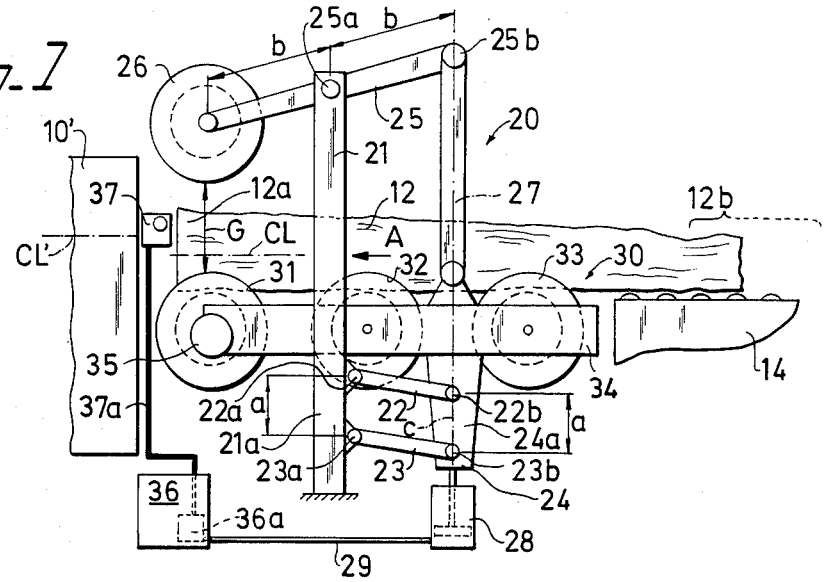

Parts with like function are in all drawing figures provided with like or similar reference numerals.

In FIG. 1 is schematically demonstrated the principle of the present invention. On a conventional driven feeder conveyor 14 a log 12 is fed to the feeder device 20 according to the present invention. The feeder device 20 is installed closely in front of a barking machine 10' and comprises a vertical stand member 21 to which two equally long link members 22, 23 are pivoted at their first ends *22a*, *23a*, vertically spaced one from another by a distance a. The link members, each of which expediently consists of a pair of link arms, extend upstream the direction of feed A and are disposed at their other ends *22b*, *23b* at the same mutual vertical spacing a pivoted to an elongated, vertically extending and vertically movable carrier means 24. A vertical parallel mechanism is thus obtained which comprises the two link members 22, 23, the portion *24a* of the carrier means 24 extending between the pivots *22b*, *23b* and, in the capacity of a stationary vertical part, the portion *21a* of the vertical stand member 21 extending between the pivots *22a* and *23a*.

A horizontally extending elongated body portion 34 of a lengthwise conveyor 30 is attached to the carrier means 24 at right angles to a line c passing through the pivot points *22b*, *23b*. The conveyor 30 is provided with three double-conic rollers 31, 32, 33 (so-called "diabolo rollers"), the indrawn part of which is shown in dashed lines. At least one of these rollers is driven, e.g. roller 31, by a hydraulic motor 35.

An arm member 25 is at *25a* pivoted to the vertical stand member 21 over the pivot point *22a* of the upper link member 22. In the example shown, the arm member 25 extends at both sides from the pivot point *25a* and carries at equal distances b therefrom on one end a freely rotatable double-conic roller 26 in the capacity of an engagement means located above the roller 31, and on the other end a vertical connecting link means 27 which at its lower end is pivoted to the carrier means 24.

A cylinder-piston-unit 28 driven by a pressure medium affects the carrier means 24 to lift and lower the same. The unit 28 is supplied with pressure medium from a source 36 via a pilot valve *36a* and a supply conduit 29. When the pilot valve *36a* is closed, the conveyor 30 is in its lowermost position which also is its rest or initial position in which it is aligned with the conveyor 14. The roller 26 is at the same time in its highest position which is its rest or initial position. The gap G between the conveyor 30 and the engagement means 25, 26 is therefore largest in the rest or initial position of the device and exceeds the expected maximum diameter of objects to be processed, e.g. logs.

The mechanical coupling of the roller 26 with the conveyor 30 with the aid of the arm member 25 and the connecting link means 27 causes, when the conveyor 30 is moved by the driving means 28 a certain distance upward, the roller 26 to be moved by the same distance downward so that the center line $C_L$ of all logs, disregarding their diameter, always has the same vertical position. The log is centered when fed into the machine 10' having a center line $C_L'$. FIG. 1 shows this state not yet fully achieved.

A limit switch means such as a photo cell device 37 is provided in the region of the most rearward roller 31 in the direction of feed A. Switch 37, via a line 37*a*, is connected to the pilot valve 36*a* in order to actuate it. The barker 10', closely adjacent to the feeder device 20, has no feeder rollers of its own and includes in principle only a drive unit, a rotor unit and a feed-out device located at the feed-out side thereof, not visible in the drawing.

The device of FIG. 1 works as follows. The logs 30 are supplied to the feeder device 20 by the feeder conveyor 14 which is located near and upstream of the feeder device. The conveyor 30 of the feeder device is in its lowermost position, i.e. at the same level as conveyor 14, when a log is being received. When the fore end 12*a* of the log has reached the limit switch 37, a pulse is generated in the switch and supplied to the valve 36*a* governing the flow of pressure medium from the source 36 to the cylinder-piston unit 28, and unit 28 begins to lift the conveyor 30. The driving means 28, 29, 36 are dimensioned so as to be able to lift and carry the conveyor 30 and a log 12 having the greatest expected weight. Due to the parallel mechanism with the link members 22, 23, the conveyor 30 keeps its horizontal position during elevation. At the same time as the conveyor 30 is lifted, the arm member 25 is affected by the connecting link 27 and roller 26 is lowered until it reaches the upper side of the log 12 and presses the log onto the roller 31. The center line $C_L$ of the log coincides with the center line $C_L'$ of the barker 10' and the log continues to be squeezed between the rollers 35 and 26 due to the fact that unit 28 continues to be supplied by source 36.

If the log happens to be so long that its rear portion 12*b* weighs down over the upstream roller 33, roller 26 on the arm member 25 will still press it down against the downstream roller 31 so that the log all the same will be in horizontal position when fed-in into the barker 10'. The arm member 25 is designed so as to be able to hold any log within reasonable length limits and weigh limits and may be e.g. dimensioned to hold at least half the weigh of the heaviest log. Consequently, the conveyor 30 has not to be as long as the logs are. Moreover, thanks to the firm grip of the co-operating rollers 26 and 31, the log 12 is safely prevented from rotating round its center line $C_L$.

When the log 12 has so far entered into the barker 10' that its rear edge, not shown, has passed the photo cell device 37, a pulse is generated for the pilot valve 36*a* to interrupt the supply of pressure medium to the unit 28. In consequence thereof, conveyor 30 is by its own weigh again returned into the lowermost position where it is ready to receive another log from the feeder conveyor 14.

Figure 2:
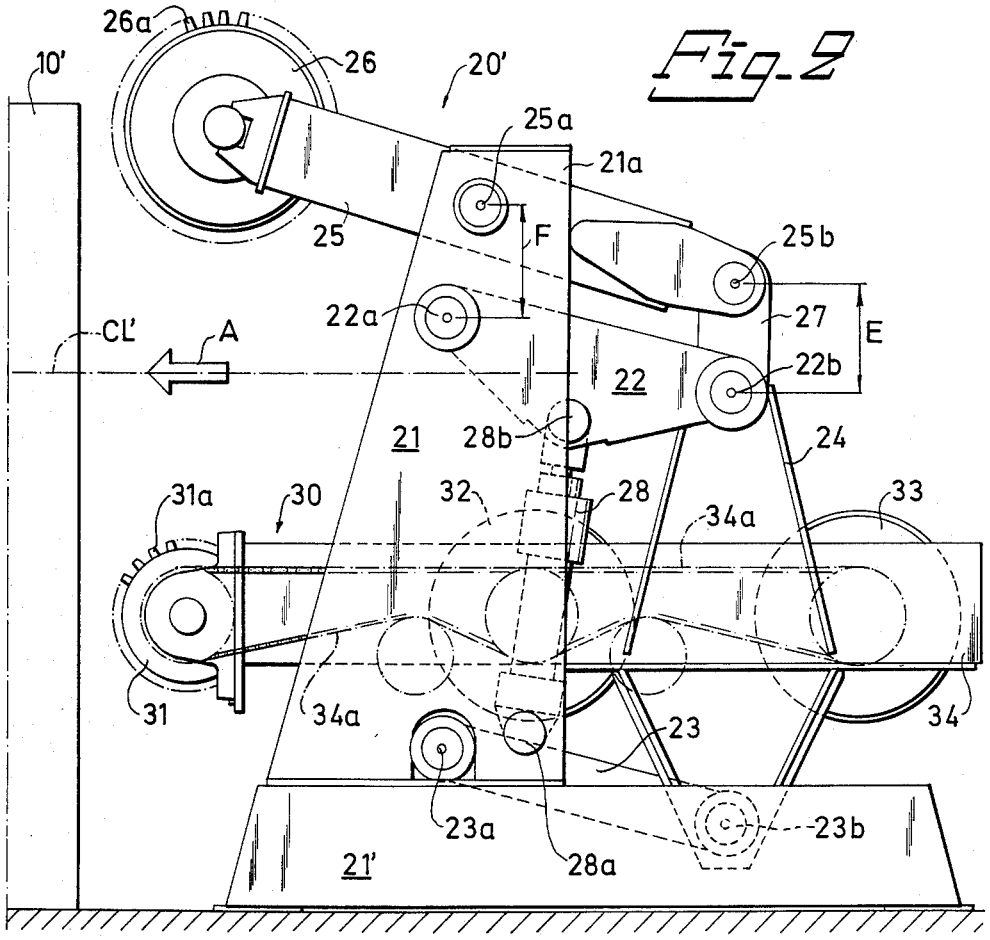
Figure 3:
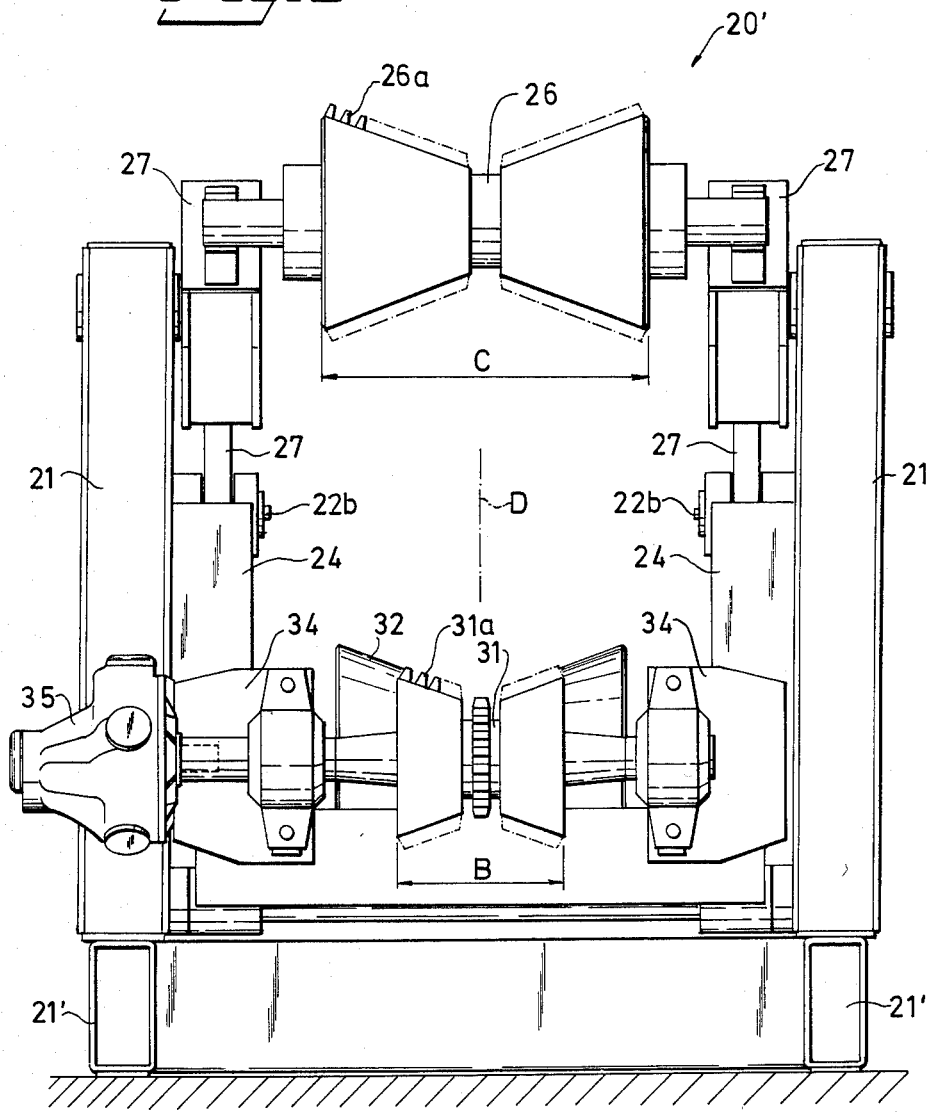

According to FIGS. 2 and 3, an exemplary embodiment of a feeder device 20' according to the invention is, with a few exceptions, symmetrically constructed relative a lengthwise extending plane of symmetry D (FIG. 3), so that the description of the one side seen in FIG. 2 applies also to the other side. The stand has a horizontal base portion 21' from which the vertical stand member 21 projects. The body 30 of the conveyor 34 carries two smooth double-conic rollers 32, 33 and, as the last roller in the direction of feeding A, a double-conic roller 31 provided with engagement-promoting spikes 31*a*. As will be best seen from FIG. 3, the double-conic rollers 31, 32, 33 have a narrowest portion in the middle of their length. A hydraulic motor 35 is connected to the shaft of the roller 31 to drive it directly, and also to drive, via a chain drive 34*a*, the two other rollers. The body 34 of the conveyor 30 is welded to the carrier means 24 which has an upper portion including two bars converging upward and a lower portion including two downward converging bars and a triangle-shaped shield plate. Contrary to FIG. 2, only the lower link member 23 is disposed under the conveyor 34, while the upper link member 22 is arranged over the conveyor 34. The connecting link means 27 has essentially the same length E as the vertical distance F between the pivot points 22*a* and 25*a* on the stand member 21 is, so that the arm member 25 pivots substantially parallel with the link members 22 and 23. In addition, a second parallel mechanism with corners at 22*a*, 25*a*, 25*b*, 22*b* and with a stationary vertical part located on the stand member 21 and having a length F, is provided.

The cylinder-piston unit 28 is at its lower end pivotally attached to the stand at 28*a*, and is at its upper end pivotally attached to the upper link member 22 at a point 28*b* located in the middle between the two pivot points 22*a*, 22*b* of the link member. The means 14, 29, 36, 36*a*, 37 and 37*a* are, for clarity, not shown in FIG. 2 (or FIG. 4), but are also provided.

The double-conic spiked roller 31 has a shorter length B (FIG. 3) than the length C of the roller 26 on the arm member 27, also spiked. Thereby is obtained that these two rollers may come closer together than otherwise would be the case when their outer peripheries would hit one another. Due to this arrangement, even thin logs may be grasped by the two rollers 26, 31. The same effect will of course be achieved if the length relation between the two rollers 26, 31 is reversed, but the arrangement shown has the advantage that operation of the shorter roller 31 is to a certain degree complemented by the longer rollers 32 and 33 affecting the same side of the log.

Figure 4:
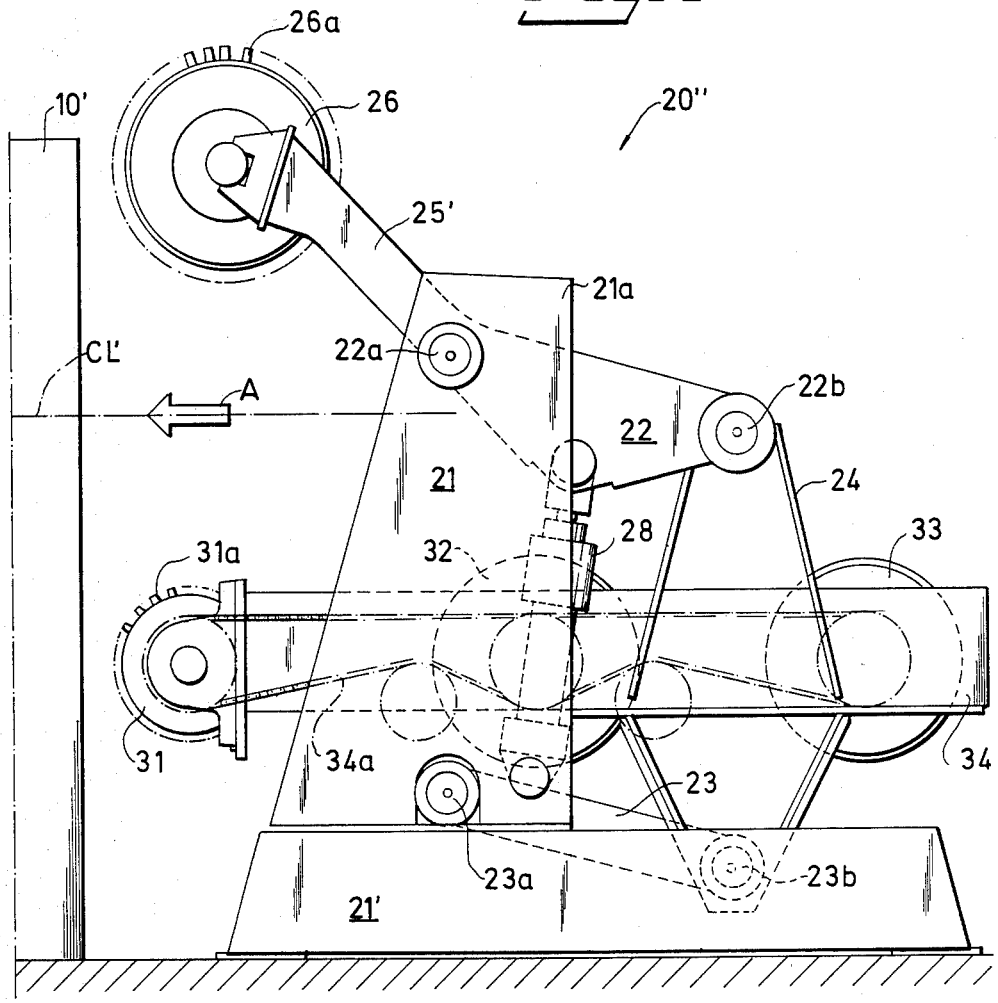

The feeder device 20" according to FIG. 4 differs from the embodiment of FIGS. 2 and 3 by the provision of an extension 25' on the upper link member 22 to carry the engagement means defined by the roller 26, instead of the separate arm member 25.

It will be appreciated that several other modifications are possible within the scope of the invention. E.g. the link members 22, 23 can extend downstream relative to the feeding direction A, or the vertical stand member 21 may be located closer to the feed-in end of the conveyor 30. Instead of the spikes 26*a*, 31*a* other engagement-promoting means, known per se, such as herringbone gearing etc may be used, and the other rollers of the conveyor 30 may be additionally provided with such means.

Generally, even other conveyor means with a side-centering function may be used, such as a feeder trough, and analogically the double-conic roller 26 on the arm member 25 can be replaced by some other means, e.g. a pair of cylindrical rollers with inclined axes. The roller 26 or an equivalent means in its stead may also be driven in synchronism with the roller 31 or an equivalent means in its stead, e.g. by a separate hydraulic motor, analogous to motor 35. The photo cell device 37 may be replaced by a mechanical limit switch means.

Although the invention has been described in detail with the aid of examples taken from the log processing industry, it will be appreciated that it may be applied also in other fields of technics, e.g. for the manipulation of ingots etc.

What is claimed is:

1. A device for feeding elongated objects such as logs into a processing machine having a center line ($C_L'$) about which processing functions are carried out, said elongated objects being centered relative to said center line at least vertically, said feeding device including a vertically extending stand member, a horizontally extending, vertically adjustable conveyor means mounted in said stand member including pivotally attached carrier means, a rotatable engagement means adapted to engage from above an object on said conveyor means, said engagement means being mechanically coupled to said carrier means for movement through the same distance above said center line as the conveyor means is moved thereunder, and a driving means, supplied by energy from an outer source, for lifting the conveyor means towards said center line, said feeding device comprising;

two elongate link members having first and second ends, said link members both extending in the same direction from said stand member and having said first ends pivotally attached to the stand member, at a predetermined vertical spacing (a) one from another, said link members pivotally carrying at said second ends, having the same vertical spacing (a) as the first ends, said carrier means to which the conveyor means is firmly attached, parallel means, including a stationary portion located on said stand member, for vertically adjustably carrying said conveyor means, an arm member carrying said engagement means, said arm member being pivoted to the vertical stand member and extending in a direction opposite to the direction of said link members, and sensor means having the function of a limit switch for triggering the supply of energy to the driving means when the leading end of said conveyor means-supported object has reached a position beneath said engagement means, said sensor means including means for discontinuing the supply of energy when the trailing end of the object has passed said position, said conveyor means-supported object being positively clamped between the conveyor means and the engagement means during the entire feeding procedure by the force generated by the driving means, and having its longitudinal center line centered relative to said processing machine center line when said leading end of said conveyor means-supported object reaches said processing machine.

2. A feeding device according to claim 1, wherein said link members protrude from the vertical stand member upstream of the direction of feed of the conveyor means and the arm member which carries the engagement means extends downstream of said direction.

3. A feeding device according to claim 1, wherein the conveyor means includes at least two rotatable rollers, at least one roller being drivable by a motor, and the engagement means comprises a roller.

4. A feeding device according to claim 1, wherein said conveyor means includes at least one roller having a concave cross-section with a middle portion being of smallest diameter so that lateral centering of said conveyor means-supported object on said conveyor means is obtained.

5. A feeding device according to claim 4, wherein each of said at least one roller is a double-conic roller.

6. A feeding device according to claim 5, wherein said engagement means comprises a double-conic roller, and one of said conveyor means rollers located under said engagement means roller is of shorter length than said engagement means roller so that the two rollers may closely approach one another.

7. A feeding device according to claim 1, wherein said arm member comprises an extension of the uppermost of said link members beyond its point of pivotal attachment to said stand member.

8. A feeding device according to claim 1, wherein said arm member comprises a separate part pivotally attached to said stand member above the uppermost of said link members said separate part further being pivotally attached, via a connection link, with said uppermost link member.

9. A feeding device according to claim 8, wherein said arm member is pivotally attached to said stand member at spaced pivot points, and the length (E) of said connection link substantially corresponds to a vertical distance (F) between the pivot points of the arm member and of the upper link member on the vertical stand member.

10. A feeding device according to claim 1, and further including a cylinder-piston unit having one end pivotally attached to the stand member and another end pivotally attached to the upper link member midway between the two ends of said upper link member.

* * * * *